US011492745B2

(12) United States Patent
Shan et al.

(10) Patent No.: US 11,492,745 B2
(45) **Date of Patent: *Nov. 8, 2022**

(54) LIFTING DEVICE AND WASHING MACHINE HAVING SAME

(71) Applicants: QINGDAO HAIER DRUM WASHING MACHINE CO., LTD., Shandong (CN); Haier Smart Home Co., Ltd., Shandong (CN)

(72) Inventors: Shiqiang Shan, Qingdao (CN); Huacheng Song, Qingdao (CN); Sheng Xu, Qingdao (CN); Peishi Lv, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 282 days.

This patent is subject to a terminal disclaimer.

(21) Appl. No.: 16/958,828

(22) PCT Filed: Nov. 7, 2018

(86) PCT No.: PCT/CN2018/114291
§ 371 (c)(1),
(2) Date: Jun. 29, 2020

(87) PCT Pub. No.: WO2019/128480
PCT Pub. Date: Jul. 4, 2019

(65) Prior Publication Data

US 2021/0079583 A1 Mar. 18, 2021

(30) Foreign Application Priority Data

Dec. 29, 2017 (CN) ..... 201711472343.8

(51) Int. Cl.
*D06F 39/12* (2006.01)
*D06F 39/00* (2020.01)
*B66F 3/44* (2006.01)

(52) U.S. Cl.
CPC ..... *D06F 39/001* (2013.01); *B66F 3/44* (2013.01); *D06F 39/125* (2013.01)

(58) Field of Classification Search
CPC ..... D06F 39/125; D06F 39/001; B66F 33/44
See application file for complete search history.

(56) References Cited

U.S. PATENT DOCUMENTS 2,783,055 A * 2/1957 Michaud ..... B62B 3/0625 16/34
2,812,189 A * 11/1957 Geldhof ..... D06F 39/125 16/34

(Continued)

FOREIGN PATENT DOCUMENTS

CN 104032543 A 9/2014
CN 104975468 A 10/2015

(Continued)

OTHER PUBLICATIONS

International Search Report dated Feb. 14, 2019 in corresponding International application No. PCT/CN2018/114291; 6 pages.

*Primary Examiner* — Joseph L. Perrin
(74) *Attorney, Agent, or Firm* — Maier & Maier, PLLC

(57) ABSTRACT

A lifting device and a washing machine to resolve difficulty moving a washing machine. The device includes a driving device, a connection rod, a first lever, a second lever and support legs, where the driving device is on the bottom of a washing machine body; the support legs are arranged at the bottom of the body; the driving device is connected to a first end of the first lever and to a first end of the second lever in a driving manner, by the connection rod; a second end of the first lever is connected to one of the support legs, and a (Continued)

pivoting end of the first lever is connected to the washing machine body; and a second end of the second lever is connected to one of the support legs, and a pivoting end of the second lever is connected to the washing machine body.

9 Claims, 2 Drawing Sheets

(56) References Cited

U.S. PATENT DOCUMENTS

| | | | | |
|---|---|---|---|---|
| 4,124,187 | A * | 11/1978 | Webb | D06F 39/125 248/188.3 |
| 2007/0145229 | A1* | 6/2007 | Johnson | F16M 11/42 248/646 |
| 2012/0025050 | A1* | 2/2012 | Ma | F16H 21/54 74/532 |
| 2012/0305866 | A1* | 12/2012 | Kraus | B60B 33/04 254/84 |

FOREIGN PATENT DOCUMENTS

| | | | |
|---|---|---|---|
| CN | 207295257 | U | 5/2018 |
| GB | 719750 | A | 12/1954 |

* cited by examiner

LIFTING DEVICE AND WASHING MACHINE HAVING SAME

FIELD

The present invention belongs to the field of household appliances, and specifically provides a lifting device and a washing machine having the lifting device.

BACKGROUND

At present, most washing machines are difficult to move. For the convenience of transportation, hand buckles are often disposed on both sides of the washing machine, and the washing machine can be moved only by manual lifting; some washing machines are provided with casters on a bottom support plate of the machine body to facilitate the movement of the washing machines; and some washing machines are provided with hydraulic and pneumatic devices on the bottom support plate of the machine body to prevent the casters from directly contacting the ground to bear the weight by realizing the raising/lowering of the washing machines.

However, existing technical solutions still have certain problems, such as time and labor consuming; and wheel bodies of the casters directly contact the ground to bear the weight, so the wheel bodies are easily deformed and damaged during use, and will fail to function, thus causing the machine body of the washing machine to tilt and affecting the normal use; the installation of hydraulic and pneumatic devices not only leads to a complicated structure, but also causes certain noises, which will affect the user's feeling and experience during use.

Accordingly, there is a need for a new washing machine in the art to solve the above problems.

SUMMARY

In order to solve the above problems in the related art, that is, to solve the problems that the existing washing machines are difficult to move and the existing mobile devices have a complicated structure, the present invention provides a lifting device, wherein the lifting device includes a driving device, a connecting rod, a first lever having a first length, a second lever having a second length, and a plurality of support feet; the driving device is disposed at the bottom of the supported apparatus, and the support feet are vertically movably disposed at the bottom of the supported apparatus; a first end of the connecting rod is pivotally connected to the driving device, and a second end of the connecting rod is pivotally connected to a first end of the first lever and a first end of the second lever respectively; a second end of the first lever is pivotally connected to one of the support feet, and the first lever is pivotally connected to the supported apparatus between the first end and the second end thereof; a second end of the second lever is pivotally connected to another one of the support feet, and the second lever is pivotally connected to the supported apparatus between the first end and the second end thereof.

In a preferred technical solution of the above lifting device, the lifting device further includes a connector, wherein a first end of the connector is fixedly connected to an output shaft of the driving device, and a second end of the connector is pivotally connected to the first end of the connecting rod.

In a preferred technical solution of the above lifting device, the lifting device further includes a first cylindrical pin, and the second end of the connector is pivotally connected to the first end of the connecting rod through the first cylindrical pin; and/or the lifting device further includes a second cylindrical pin, and the second end of the connecting rod is pivotally connected to the first end of the first lever and the first end of the second lever respectively through the second cylindrical pin.

In a preferred technical solution of the above lifting device, the first end of the first lever is provided with a first sliding groove which is slidingly connected to the second cylindrical pin; and/or the first end of the second lever is provided with a second sliding groove which is slidingly connected to the second cylindrical pin.

In a preferred technical solution of the above lifting device, the second end of the first lever is provided with a third sliding groove, through which the first lever is pivotally connected to the corresponding support foot; and/or the second end of the second lever is provided with a fourth sliding groove, through which the second lever is pivotally connected to the corresponding support foot.

In a preferred technical solution of the above lifting device, the driving device includes a power device and a speed reducer, wherein the speed reducer is connected to the supported apparatus, the power device is connected to the speed reducer, an output shaft of the power device is fixedly connected to an input shaft of the speed reducer, and an output shaft of the speed reducer is fixedly connected to the first end of the connector.

In a preferred technical solution of the above lifting device, the power device is an electric motor.

In a preferred technical solution of the above lifting device, a walking wheel is disposed at the bottom of the support foot.

In a preferred technical solution of the above lifting device, the walking wheel is a universal wheel.

In addition, the present invention also provides a washing machine, which includes a machine body and a lifting device disposed at the bottom of the machine body, wherein the lifting device is the lifting device according to any one of the above preferred technical solutions of the lifting device.

It can be understood by those skilled in the art that in the preferred technical solution of the present invention, the first lever and the second lever are driven by the driving device through the connecting rod, so that the first lever and the second lever drive the support feet to move in the vertical direction, thereby raising or lowering the machine body of the washing machine. Therefore, the raising or lowering of the machine body of the washing machine can be realized by the lifting device of the present invention, and the lifting device of the present invention has a simple structure, which makes the movement of the washing machine more convenient and faster and optimizes the user's experience during use.

Further, in the preferred embodiment of the present invention, the first lever has a first length and the second lever has a second length, wherein the first length is not equal to the second length. When the positions of the support feet are fixed, the installation position of the driving device located between the two levers can be adjusted by adjusting the values of the first length and the second length, so that the driving device can be prevented from interfering with the driving motor and a drain pipe at the bottom of the washing machine. Correspondingly, the distances from the pivotal connection point of the first lever and the second lever with the washing machine to the other ends of the first lever and the second lever are set to match each other such that when the driving device drives the first lever and the second lever to pivot, the support feet connected to the first lever and the second lever have the same maximum strokes of the movement in the vertical direction, thereby preventing the washing machine from being tilted after being raised.

Further, the bottom of the support foot is provided with a walking wheel, the first end of the first lever is drivingly connected to the driving device through the connecting rod, the second end of the first lever is pivotally connected to the support foot, and a pivoting end of the first lever is pivotally connected to the machine body of the washing machine. The first end of the second lever is drivingly connected to the driving device through the connecting rod, the second end of the second lever is pivotally connected to the support foot, and a pivoting end of the second lever is pivotally connected to the machine body of the washing machine. When the driving device is operating, it drives the first end of the first lever and the first end of the second lever to move up and down through the connecting rod, thereby driving the second end of the first lever and the second end of the second lever to move up and down, and further driving the walking wheels corresponding to the first lever and the second lever to move in the vertical direction, so that the machine body is raised or lowered. When the machine body is raised, the washing machine can be easily pushed by the user by means of the walking wheels; and when the machine body is lowered, the washing machine can be firmly fixed on the ground by means of the fixed feet. In this way, the user experience is improved.

BRIEF DESCRIPTION OF THE DRAWINGS

Preferred embodiments of the present invention will be described below with reference to the drawings and in conjunction with a washing machine. In the drawings.

LIST OF REFERENCE SIGNS

Figure 1:
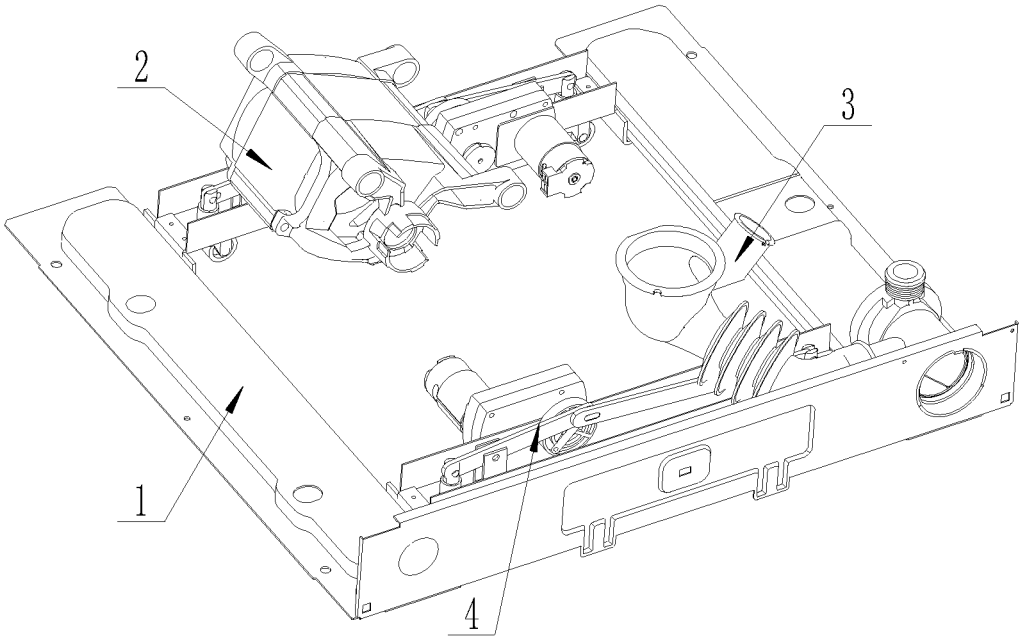
FIG. 1 is a schematic structural view of a bottom of a machine body of a washing machine of the present invention.

1: machine body; 11: first support bracket; 12: second support bracket; 13: first sliding sleeve; 14: second sliding sleeve; 2: driving motor; 3: drain pipe; 4: lifting device; 41: lifting motor; 42: speed reducer; 43: connector; 431: first cylindrical pin; 44: first lever; 441: first sliding groove; 442: third sliding groove; 45: second lever; 451: second sliding groove; 452: fourth sliding groove; 46: first support foot; 47: first universal wheel; 48: second support foot; 49: second universal wheel; 410: connecting rod; 4101: second cylindrical pin.

DETAILED DESCRIPTION

It should be understood by those skilled in the art that the embodiments in this section are only used to explain the technical principles of the present invention, and are not intended to limit the scope of protection of the present invention. For example, although the lifting device of the present invention is described in conjunction with a washing machine in the following embodiments, the lifting device of the present invention is also applicable to other apparatuses, such as an air conditioner, a refrigerator and a safe, etc. Those skilled in the art may make an adjustment to the lifting device as required so as to be adapted to specific application occasions. The technical solutions after the adjustment will still fall within the scope of protection of the present invention.

It should be noted that in the description of the present invention, directional or positional relationships indicated by terms such as "center", "upper", "lower", "left", "right", "vertical", "horizontal", "inner" and "outer" are based on the directions or positional relationships shown in the drawings. They are merely used for the convenience of description, and do not indicate or imply that the device or element involved must have a specific orientation, or be configured or operated in a specific orientation, and therefore they should not be construed as limiting the present invention. In addition, terms "first", "second" and "third" are only used for descriptive purposes, and should not be understood as indicating or implying relative importance.

In addition, it should also be noted that in the description of the present invention, unless otherwise clearly specified and defined, terms "install", "connect" and "connection" should be understood in a broad sense; for example, the connection may be a fixed connection, or may also be a detachable connection, or an integral connection; it may be a direct connection, or an indirect connection implemented through an intermediate medium, or it may be an internal communication between two elements. For those skilled in the art, the specific meaning of the above terms in the present invention can be understood according to specific situations.

As shown in FIG. 1, the washing machine of the present invention mainly includes a machine body 1, and a driving motor 2, a drain pipe 3 and two lifting devices 4 that are disposed at the bottom of the machine body 1. The driving motor 2 is configured to drive a drum (the drum of a drum washing machine) or a pulsator (the pulsator of a pulsator washing machine) of the washing machine to rotate. The drain pipe 3 is configured to drain water in a washing tub in the washing machine. The two lifting devices 4 are disposed on both sides of the machine body 1 respectively and are configured to raise and lower the machine body 1. When the machine body 1 is raised, the washing machine is in contact with the ground through walking wheels. At this point, the user can manually push the washing machine to walk so that the washing machine is moved to a target position. When the machine body 1 is lowered, the washing machine is in contact with the ground through fixed feet. At this point, the washing machine is firmly fixed to the ground through the fixed feet.

It should be noted that since the technical means of disposing fixed feet at the bottom of the machine body 1 and making the machine body 1 be in contact with the ground through the fixed feet is conventional technical means for those skilled in the art, and a washing machine having fixed feet is available on the market, no detailed description will be given herein.

Figure 2:
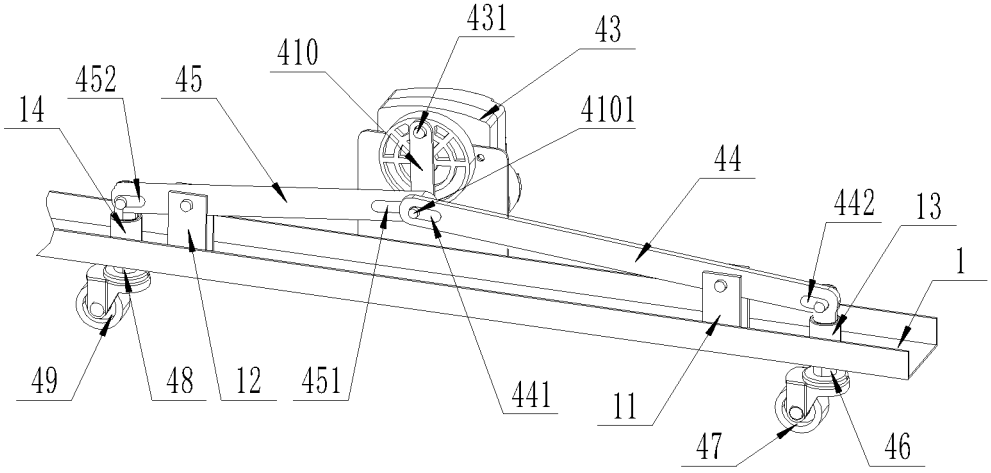
FIG. 2 is a side view of a lifting device of the present invention.
Figure 3:
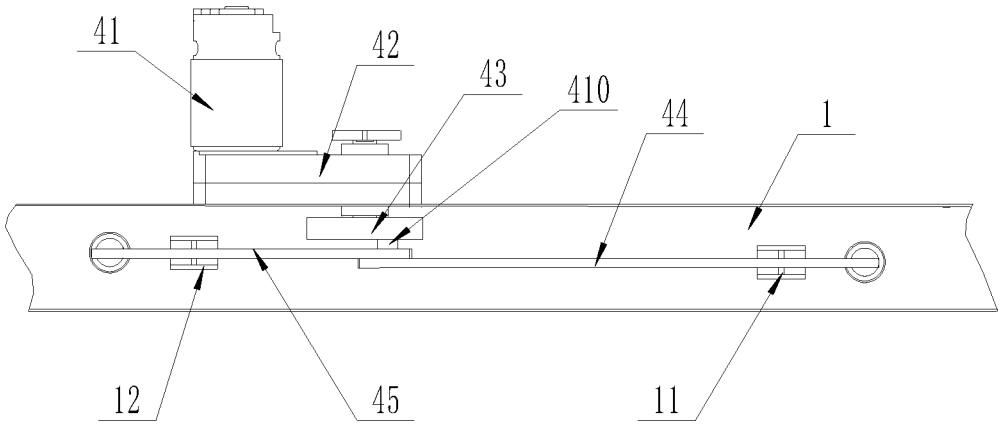
FIG. 3 is a top view of the lifting device in FIG. 2.

As shown in FIGS. 2 and 3, the lifting device 4 of the present invention mainly includes a driving device (not shown in the figures), a connecting rod 410, a first lever 44 having a first length, a second lever 45 having a second length, a first support foot 46 and a second support foot 48. The driving device is fixedly disposed at the bottom of the machine body 1, and the first support foot 46 and the second support foot 48 are respectively slidingly connected to the bottom of the machine body 1 in a vertically movable manner. In order to reduce the wear between the first support foot 46 and the second support foot 48 with the machine body 1, the machine body 1 is also fixedly provided with a first sliding sleeve 13 and a second sliding sleeve 14. The first support foot 46 is vertically movably disposed in the first sliding sleeve 13, and the second support foot 48 is vertically movably disposed in the second sliding sleeve 14. Further, the bottom of the first support foot 46 is provided with a first universal wheel 47, and the bottom of the second support foot 48 is provided with a second universal wheel 49. When the first support foot 46 and the second support foot 48 slide downward in the vertical direction, the first universal wheel 47 and the second universal wheel 49 can abut against the ground, so that the machine body 1 can contact the ground through the first universal wheel 47 and the second universal wheel 49, and further walk through the first universal wheel 47 and the second universal wheel 49. Those skilled in the art can understand that the first universal wheel 47 and the second universal wheel 49 may also be replaced by any other type of walking wheels, such as fixed casters.

With continued reference to FIGS. 2 and 3, a first end of the connecting rod 410 is pivotally connected to the driving device, and a second end of the connecting rod 410 is pivotally connected to a first end of the first lever 44 and a first end of the second lever 45 respectively. A second end of the first lever 44 is pivotally connected to the top of the first support foot 46, and a pivoting end of the first lever 44 is pivotally connected to a first support bracket 11 on the machine body 1. A second end of the second lever 45 is pivotally connected to the top of the second support foot 48, and a pivoting end of the second lever 45 is pivotally connected to a second support bracket 12 on the machine body 1. When the driving device is operating, it drives the first end of the first lever 44 and the first end of the second lever 45 to move up and down through the connecting rod 410, thereby driving the second end of the first lever 44 and the second end of the second lever 45 to move up and down, and further driving the first support foot 46 and the second support foot 48 to move in the vertical direction, so that the machine body 1 is raised or lowered. When the machine body 1 is raised, the washing machine can move by means of the first universal wheel 47 and the second universal wheel 49 and can be easily pushed by the user; and when the machine body 1 is lowered, the washing machine can be firmly fixed on the ground by means of the fixed feet.

Further referring to FIGS. 2 and 3, the driving device mainly includes a lifting motor 41, a speed reducer 42 and a connector 43. The speed reducer 42 is fixedly connected to the bottom of the machine body 1, the lifting motor 41 is disposed at an input end of the speed reducer 42, and a housing of the lifting motor 41 is fixedly connected to a housing of the speed reducer 42. A rotating shaft of the lifting motor 41 is fixedly connected to an input shaft of the speed reducer 4, the connector 43 is disposed at an output end of the speed reducer 42, and a first end of the connector 43 (the center of circle of the connector 43 shown in FIG. 2) is fixedly connected to an output shaft of the speed reducer 42. A second end of the connector 43 (a position of the connector 43 deviated from the center of circle shown in FIG. 2) is pivotally connected to the first end of the connecting rod 410. Those skilled in the art can understand that the connector 43 is not limited to the circular structure shown in the figure, and it may also be any other feasible structure, such as a bar structure, a cam structure, a rod structure, and the like. Those skilled in the art can also understand that the lifting motor 41 can be replaced by any other feasible power devices, such as a hydraulic motor and a pneumatic motor.

Those skilled in the art can understand that during the practical application, the first end of the connecting rod 410 can either be below the second end of the connecting rod 410 (as shown in FIG. 1), or be above the second end of the connecting rod 410 (as shown in FIG. 2).

In other feasible technical solutions of the present invention, those skilled in the art may also dispense with the speed reducer 42 as required, so that the output shaft of the lifting motor 41 is directly fixedly connected to the first end of the connector 43. However, in this situation, it is necessary to reduce the rotational speed of the lifting motor 41 to reduce the speed of up-and-down movement of the first support foot 46 and the second support foot 48, thereby preventing the washing machine from being raised and lowered too fast and avoiding the occurrence of shaking and noise. In addition, those skilled in the art can also dispense with the connector 43 as required, so that the first end of the connecting rod 410 is fixedly connected to the output shaft of the lifting motor 41 or the speed reducer 42.

As shown in FIG. 2, the second end of the connector 43 is provided with a first cylindrical pin 431, and the second end of the connector 43 is pivotally connected to the first end of the connecting rod 410 through the first cylindrical pin 431. The second end of the connecting rod 410 is provided with a second cylindrical pin 4101, and the second end of the connecting rod 410 is pivotally connected to the first end of the first lever 44 and the first end of the second lever 45 respectively through the second cylindrical pin 4101. When the connector 43 rotates and drives the connecting rod 410 to move up and down, in order to prevent the second cylindrical pin 4101 from interfering with the first lever 44 in the horizontal direction, the first end of the first lever 44 is provided with a first sliding groove 441 so that the second cylindrical pin 4101 is slidingly connected to the first sliding groove 441. In order to prevent the second cylindrical pin 4101 from interfering with the second lever 45 in the horizontal direction, the first end of the second lever 45 is provided with a second sliding groove 451 so that the second cylindrical pin 4101 is slidingly connected to the second sliding groove 451. When the connector 43 rotates and drives the connecting rod 410 to move up and down, while the second cylindrical pin 4101 is sliding in the first sliding groove 441, it drives the first end of the first lever 44 to move up and down, so that in a case where the pivoting end of the first lever 44 serves as a fulcrum, the first lever 44 can drive the first support foot 46 to move up and down through the pivoting end. During the rotation of the connector 43, while the second cylindrical pin 4101 is sliding in the second sliding groove 451, it drives the first end of the second lever 45 to move up and down, so that in a case where the pivoting end of the second lever 45 serves as a fulcrum, the second lever 45 can drive the second support foot 48 to move up and down through the pivoting end.

Those skilled in the art can understand that since the first end of the connecting rod 410 and the connector 43 are pivotally connected through the first cylindrical pin 431, the second end of the connecting rod 410 can swings relative to the first end of connecting rod 410 around the first cylindrical pin 431. Therefore, the first sliding groove 441 and the second sliding groove 451 can be provided in an alternative way. Exemplarily, only the second sliding groove 451 is provided. When the first end of the connecting rod 410 moves up and down with the connector 43, the second end of the connecting rod 410 can move in the horizontal direction adaptively with the first end of the first lever 44 while the second end of the connecting rod 410 drives the first end of the first lever 44 to move vertically. At the same time, while the second end of the connecting rod 410 drives the first end of the second lever 45 to move vertically, by means of the sliding connection between the second cylindrical pin 4101 and the second sliding groove 451, the second cylindrical pin 4101 disposed at the second end of the connecting rod 410 is prevented from interfering with the first end of the second lever 45 in the horizontal direction.

As shown in FIG. 2, the second end of the first lever 44 is provided with a third sliding groove 442. The first lever 44 is pivotally connected to the first support foot 46 by passing a pin (not shown in the figure) through the third sliding groove 442 and the top of the first support foot 46. Those skilled in the art can understand that the third sliding groove 442 can prevent the first support foot 46 from interfering with the first lever 44 in the horizontal direction when the first support foot 46 moves up and down. The second end of the second lever 45 is provided with a fourth sliding groove 452. The second lever 45 is pivotally connected to the second support foot 48 by passing a pin (not shown in the figure) through the fourth sliding groove 452 and the top of the second support foot 48. Those skilled in the art can understand that the fourth sliding groove 452 can prevent the second support foot 48 from interfering with the second lever 45 in the horizontal direction when the second support foot 48 moves up and down.

As shown in FIGS. 2 and 3, the length of the first lever 44 is a first length, the length of the second lever 45 is a second length, and the first length and the second length may be any value. In a preferred embodiment of the present invention, the first length is greater than the second length, so that the lifting motor 41 and the speed reducer 42 are disposed on the machine body 1 at a position near the second support foot 48, which enables the lifting motor 41 and the speed reducer 42 to avoid the driving motor 2 and the drain pipe 3 as shown in FIG. 1. Therefore, without changing the structure of the existing washing machine, by adjusting the values of the first length and the second length, the installation positions of the lifting motor 41 and the speed reducer 42 on the machine body 1 can be changed, so that the lifting motor 41 and the speed reducer 42 can avoid the driving motor 2, the drain pipe 3 and other parts at the bottom of the machine body 1.

Further, by adjusting the distance between the first support bracket 11 and the first support foot 46 and adjusting the distance between the second support bracket 12 and the second support foot 48, it can be ensured that when the first cylindrical pin 431 rotates directly above the connector 43, the length by which the first support foot 46 protrudes out of the bottom of the machine body 1 and the length by which the second support foot 48 protrudes out of the bottom of the machine body 1 are the same, that is, it can be ensured that the machine body 1 will not tilt after being raised.

Figure 4:
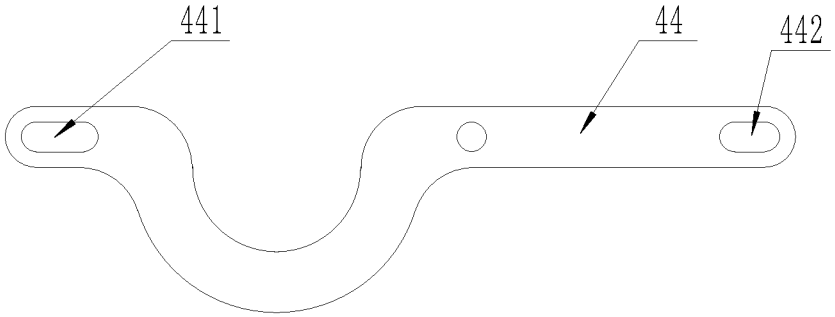
FIG. 4 is a schematic view showing the effect of a first lever of the present invention having an arc structure.

It should be noted that the first lever 44 and the second lever 45 of the present invention are not limited to the bar-shaped connecting rods shown in FIGS. 2 and 3, but may also be connecting rods of any other shapes. Exemplarily, as shown in FIG. 4, in another embodiment of the present invention, the first lever 44 has an arc-shaped structure (not shown in the figure). In the installed state, the first lever 44 can avoid the drain pipe 3 through the arc-shaped structure so that the first lever 44 is prevented from interfering with the drain pipe 3 during the rotation. Those skilled in the art may set the second lever 45 to have the same structure as the first lever 44 as required.

The operational principle of the lifting device 4 of the present invention will be described in detail below with reference to FIGS. 1 and 2.

When the washing machine needs to move, the lifting motor 41 drives the connecting rod 410 to move upward through the speed reducer 42, and further drives the first end of the first lever 44 and the first end of the second lever 45 to move upward, so the second end of the first lever 44 and the second end of the second lever 45 move downward respectively under the action of the principle of leverage, thereby driving the first support foot 46 and the second support foot 48 to move downward. When the connecting rod 410 drives the first end of the first lever 44 and the first end of the second lever 45 to rotate to the uppermost positions, the first support foot 46 and the second support foot 48 are extended to the maximum stroke. At this point, the first universal wheel 47 and the second universal wheel 49 are in contact with the ground, the machine body 1 is jacked up, and the fixed feet at the bottom of the machine body 1 are separated from the ground. With the washing machine being supported by the first universal wheel 47 and the second universal wheel 49, the user can easily push the washing machine.

When the washing machine moves into position and needs to be lowered, the lifting motor 41 drives the connecting rod 410 to move downward through the speed reducer 42, and further drives the first end of the first lever 44 and the first end of the second lever 45 to move downward, so the second end of the first lever 44 and the second end of the second lever 45 move upward respectively under the action of the principle of leverage, thereby driving the first support foot 46 and the second support foot 48 to move upward. When the connecting rod 410 drives the first end of the first lever 44 and the first end of the second lever 45 to rotate to the lowermost positions, the first support foot 46 and the second support foot 48 are completely retracted. At this point, the first universal wheel 47 and the second universal wheel 49 are out of contact with the ground, and the machine body 1 is in contact with the ground through the fixed feet at the bottom.

It should be noted that in the preferred embodiment of the present invention, the lifting motor 41 preferably has a power-off self-locking device (such as a motor-holding brake device). When the lifting motor 41 is powered off, the lifting motor 41 can also be maintained at the current angle, so that the first universal wheel 47 and the second universal wheel 49 can be maintained at the current positions. Therefore, the first universal wheel 47 and the second universal wheel 49 can be ejected by the user when the washing machine is powered on. After the washing machine is powered off, the washing machine can still be pushed, thereby ensuring that the washing machine can be pushed to any place without power supply by means of the first universal wheel 47 and the second universal wheel 49.

Although not shown in the figures, in another embodiment of the present invention, those skilled in the art may also dispense with the first universal wheel 47 and the second universal wheel 49 as required, so that the machine body 1 can be moved by other devices (for example, a small forklift truck) after being raised by the lifting device 4.

In summary, in the preferred embodiment of the present invention, the first lever 44 and the second lever 45 are driven by the lifting motor 41, so that the first lever 44 and the second lever 45 drive the support feet 46 and 48 to move in the vertical direction to cause the machine body 1 of the washing machine to be raised or lowered. Therefore, the lifting device 4 of the present invention can realize the raising or lowering of the machine body 1 of the washing machine, and has a simple structure, which makes the movement of the washing machine more convenient and faster, and optimizes the user's experience during use.

Further, by adjusting the lengths of the first lever 44 and the second lever 45, the installation positions of the lifting motor 41 and the speed reducer 42 on the machine body 1 can be adjusted, so that the lifting motor 41 and the speed reducer 42 can be prevented from interfering with the driving motor 2 and the drain pipe 3 at the bottom of the washing machine. Therefore, the lifting device 4 of the present invention can be applied to any model of washing machine by adjusting the length of the first lever 44 and the length of the second lever 45 without re-planning the positions of the driving motor 2 and the drain pipe 3 on the machine body 1.

Hitherto, the technical solutions of the present invention have been described in conjunction with the preferred embodiments shown in the accompanying drawings, but it is easily understood by those skilled in the art that the scope of protection of the present invention is obviously not limited to these specific embodiments. Without departing from the principle of the present invention, those skilled in the art can make equivalent changes or replacements to relevant technical features, and the technical solutions after these changes or replacements will fall within the scope of protection of the present invention.

What is claimed is:

1. A lifting device, which is configured to carry a supported apparatus, the lifting device comprising: a driving device, a connecting rod, a first lever having a first length, a second lever having a second length, and a plurality of support feet;

the driving device is disposed at a bottom of the supported apparatus;

the support feet are vertically movably disposed at the bottom of the supported apparatus and a walking wheel is disposed at a bottom of each of the support feet;

a first end of the connecting rod is pivotally connected to the driving device, and a second end of the connecting rod is pivotally connected to a first end of the first lever and a first end of the second lever respectively;

a second end of the first lever is connected to one of the support feet and pivots relative to the one of the support feet, and the first lever is pivotally connected to the supported apparatus between the first end and the second end of the first lever; and a second end of the second lever is connected to another one of the support feet and pivots relative to the another one of the support feet, and the second lever is pivotally connected to the supported apparatus between the first end and the second end of the second lever.

2. The lifting device according to claim 1, further comprising a connector, wherein a first end of the connector is fixedly connected to an output shaft of the driving device, and a second end of the connector is pivotally connected to the first end of the connecting rod.

3. The lifting device according to claim 2, further comprising a first cylindrical pin, wherein the second end of the connector is pivotally connected to the first end of the connecting rod through the first cylindrical pin; and the lifting device further comprises a second cylindrical pin, and the second end of the connecting rod is pivotally connected to the first end of the first lever and the first end of the second lever respectively through the second cylindrical pin.

4. The lifting device according to claim 3, wherein the first end of the first lever is provided with a first sliding groove which is slidingly connected to the second cylindrical pin; and the first end of the second lever is provided with a second sliding groove which is slidingly connected to the second cylindrical pin.

5. The lifting device according to claim 4, wherein the second end of the first lever is provided with a third sliding groove, through which the first lever is pivotally connected to the corresponding support foot; and the second end of the second lever is provided with a fourth sliding groove, through which the second lever is pivotally connected to the corresponding support foot.

6. The lifting device according to claim 2, wherein the driving device comprises a power device and a speed reducer, the speed reducer is connected to the supported apparatus, and the power device is connected to the speed reducer; and wherein an output shaft of the power device is fixedly connected to an input shaft of the speed reducer, and an output shaft of the speed reducer is fixedly connected to the first end of the connector.

7. The lifting device according to claim 6, wherein the power device is an electric motor.

8. The lifting device according to claim 1, wherein the walking wheel is a universal wheel.

9. A washing machine, comprising a machine body and the lifting device of claim 1 disposed at a bottom of the machine body.

* * * * *